US009186026B2

(12) United States Patent
Dondurur et al.

(10) Patent No.: US 9,186,026 B2
(45) Date of Patent: Nov. 17, 2015

(54) CHIMNEY CLEANING APPARATUS AND METHOD

(75) Inventors: Mehmet Dondurur, Dhahran (SA); Ahmet Z. Sahin, Dhahran (SA)

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 749 days.

(21) Appl. No.: 13/493,894

(22) Filed: Jun. 11, 2012

(65) Prior Publication Data

US 2013/0327358 A1 Dec. 12, 2013

(51) Int. Cl.

| | |
|---|---|
| ***A46B 15/00*** | (2006.01) |
| ***A47L 7/00*** | (2006.01) |
| ***B08B 1/00*** | (2006.01) |
| ***B08B 9/043*** | (2006.01) |
| ***B08B 15/04*** | (2006.01) |
| ***F23J 3/02*** | (2006.01) |
| ***A47L 25/12*** | (2006.01) |

(52) U.S. Cl.

CPC ..... *A47L 7/0071* (2013.01); *A47L 25/12* (2013.01); *B08B 1/00* (2013.01); *B08B 9/0436* (2013.01); *B08B 15/04* (2013.01); *F23J 3/026* (2013.01)

(58) Field of Classification Search

None

See application file for complete search history.

(56) References Cited

U.S. PATENT DOCUMENTS

| | | | | |
|---|---|---|---|---|
| 640,190 | A | 1/1900 | Fradenburg | |
| 1,758,950 | A | 5/1930 | Hunecke | |
| 2,026,680 | A | 1/1936 | Jacobson | |
| 4,873,739 | A | 10/1989 | Bardini | |
| 5,842,246 | A | 12/1998 | Doyle | |
| 2003/0005543 | A1 * | 1/2003 | Keller | 15/304 |
| 2006/0191089 | A1 * | 8/2006 | Gracindo et al. | 15/144.4 |

* cited by examiner

*Primary Examiner* — Eric Golightly

(74) *Attorney, Agent, or Firm* — Richard C. Litman

(57) ABSTRACT

The chimney cleaning apparatus includes a soot-scraping scrubber attached to an adjustable handle. A receptacle is also attached to the handle for receiving the dislodged soot particles therein. In one embodiment, a vacuum system is attached to the receptacle for withdrawing the soot particles therefrom to facilitate cleanup. The apparatus can be adjusted to clean the chimney from hearth level or from roof level by switching the position of the soot-scraping scrubber and the receptacle.

9 Claims, 8 Drawing Sheets

CHIMNEY CLEANING APPARATUS AND METHOD

BACKGROUND OF THE INVENTION

1. Field of the Invention

The present invention generally relates to chimneys, and particularly to a chimney cleaning apparatus and method.

2. Description of the Related Art

Burning fossil fuels (wood, coal, etc.) in furnaces, stoves and fireplaces produces soot particles that coat the inside surfaces of flues and chimneys. The soot particles contain combustible materials that will readily ignite and burn under the proper conditions, often resulting in dangerous and damaging fires. Regular cleaning would prevent the buildup of soot on the interior walls of the chimneys and flues, thus lessening the chances of a dangerous fire.

There are many tools disclosed in the related art that are utilized for dislodging soot from the walls of chimneys and flues. Unfortunately, these tools have proven to be less than satisfactory, since they often involve dangerous ascents to the roof of a home or building and since they lack the ability to collect the dislodged soot, thereby assuring a messy cleanup. The art would certainly welcome a soot-cleaning apparatus that could be utilized from either the hearth or from roof level, and that would allow thorough chimney or flue cleaning while efficiently collecting dislodged soot. Thus, a chimney cleaning method and apparatus solving the aforementioned problems is desired.

SUMMARY OF THE INVENTION

The chimney cleaning apparatus and method provides for effective chimney or flue cleaning. The apparatus includes a soot-scraping scrubber attached to an adjustable handle. A receptacle is also attached to the handle for receiving the dislodged soot particles therein. In one embodiment, a vacuum system is attached to the receptacle for withdrawing the soot particles therefrom to facilitate cleanup.

Accordingly, the invention presents a chimney/flue cleaning arrangement that is versatile, efficient and effective. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
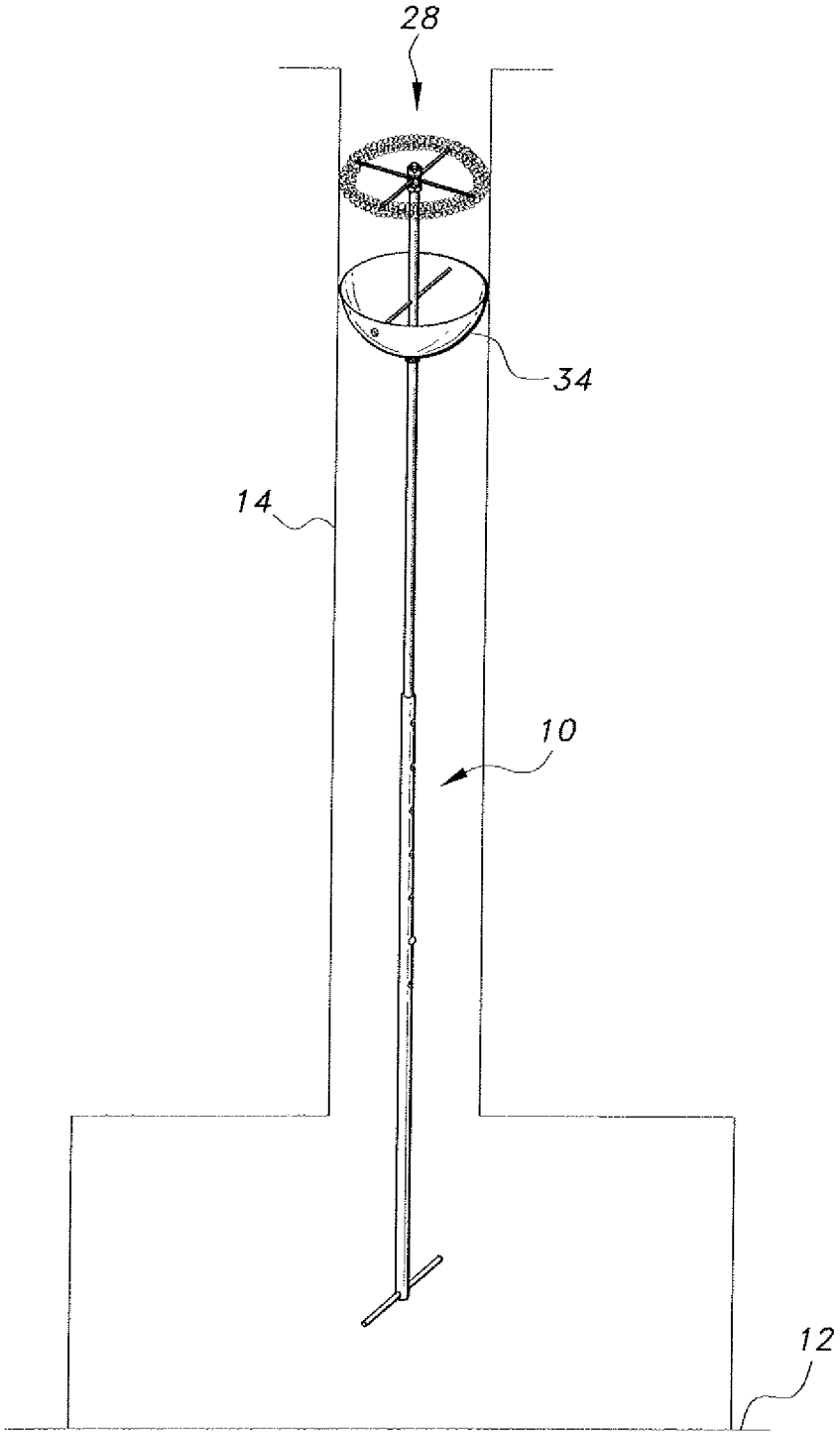
FIG. 1 is a diagrammatic environmental perspective view of a first embodiment of a chimney cleaning apparatus according to the present invention, showing the apparatus configured for cleaning the chimney from hearth or fireplace level.
Figure 2:
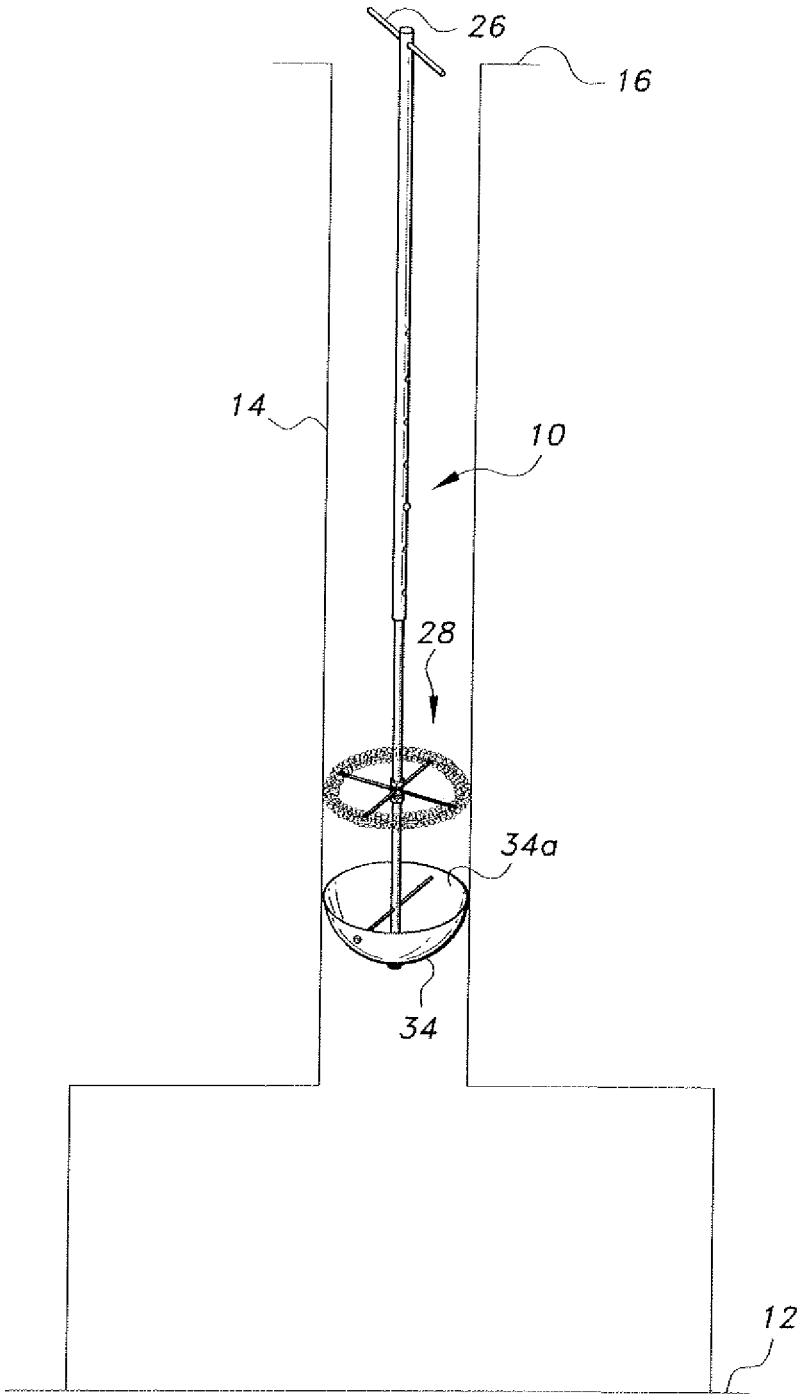
FIG. 2 is a diagrammatic environmental perspective view of the chimney cleaning apparatus of FIG. 1, showing the apparatus configured for cleaning the chimney from roof level.

Referring to FIGS. 1 and 2, in a first embodiment, the chimney cleaning apparatus 10 may be alternately configured for cleaning a chimney or flue 14 either from below (i.e., from fireplace level) or from above (i.e., from roof level). FIG. 1 shows how a user may employ the chimney cleaning apparatus 10 from hearth or fireplace level 12 to dislodge soot particles from the walls of a chimney or flue 14. FIG. 2 shows the cleaning being performed when the user is positioned at roof level 16.

Figure 3:
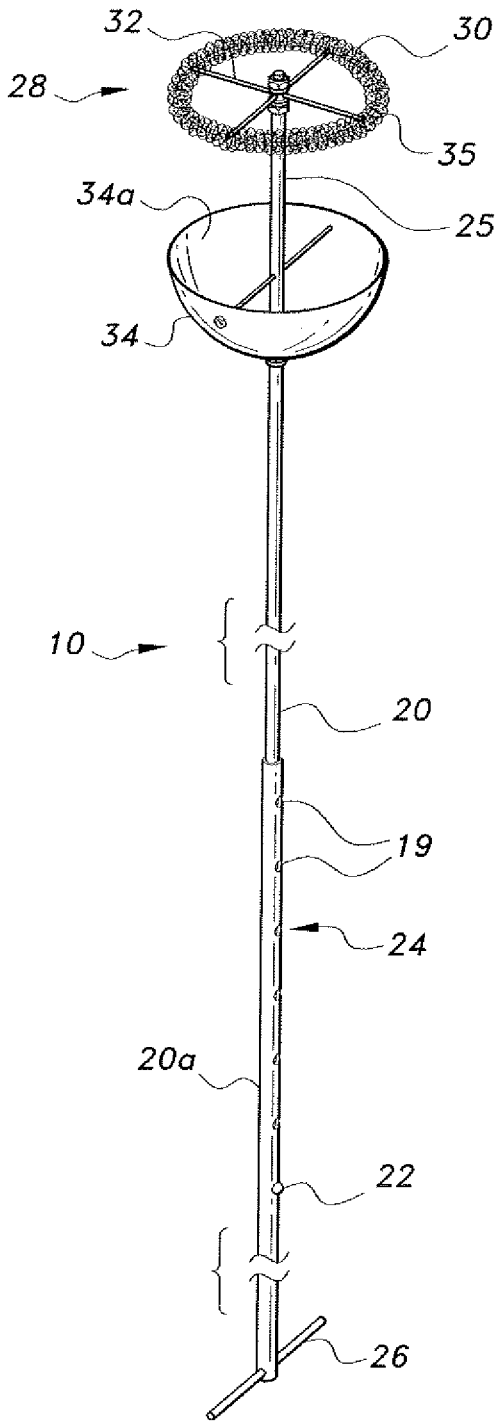
FIG. 3 is a perspective view of the chimney cleaning apparatus of FIG. 1.

As best seen in FIG. 3, the chimney cleaning apparatus 10 comprises a pole handle 24 having a hollow telescoping section 20*a* that permits adjustability. A conventional spring-biased detent 22 is mounted in handle section 20 that selectively engages spaced-apart apertures 19 along the length of the hollow telescoping handle section 20*a* so that the handle 24 may be locked in a desired length when the cleaning process is performed. A handgrip or handle-manipulating member 26 is mounted on a proximate end of the telescoping handle section 20*a* to enhance manipulation thereof.

Figure 5A:
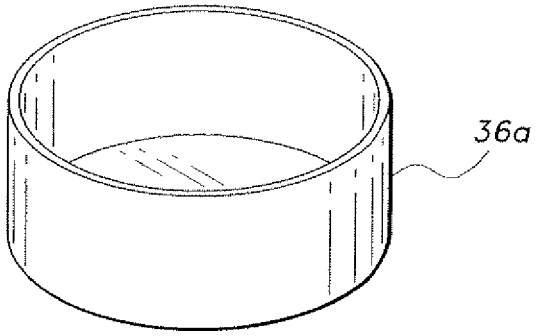
FIGS. 5A and 5B are perspective views of alternative configurations of the soot collecting receptacle of a chimney cleaning apparatus according to the present invention.
Figure 5B:
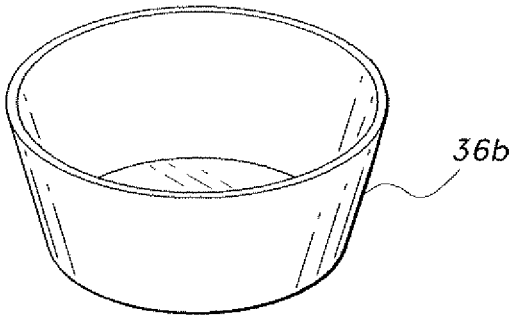

A soot-scraping scrubber 28 is adapted for removable attachment to the pole handle 24 in any conventional manner. The scrubber 28 comprises an annular ring 30 having radial spokes 32 extending from a hub having a connector for attaching the scrubber 28 to the pole handle 24. Metal scrubbing wires 35 (preferably stiff steel or copper filaments) are mounted to the entire circumferential edge of the ring 30. The scrubber 28 will have a diameter slightly smaller than the chimney or flue to be cleaned. A soot-collecting receptacle 34 is also adapted for removable attachment to the handle 24. The receptacle 34 is preferably of a circular, bowl-shaped configuration having a diameter slightly smaller than the diameter of the flue or chimney to be cleaned. The receptacle 34 defines a concave surface 34*a* that is provided to collect dislodged soot thereon. Although the circular configuration is preferred, it should be noted that other configurations may be utilized, such as (but not limited to) the receptacle 36*a* in FIG. 5A (a circular bottom and an annular wall extending 90° to the bottom) and the receptacle 36*b* in FIG. 5B (a circular bottom and a sloping annular wall extending from the bottom at an obtuse angle).

When using the tool for manually cleaning the chimney from ground or fireplace level (as shown in FIG. 1), the scrubber 28 is mounted on the distal end of the pole handle 24 and the receptacle 34 is mounted at a position between the proximal end and the distal end. When cleaning the chimney 14 from the roof (as shown in FIG. 2), the receptacle 34 will be mounted on the distal end of the handle and the scrubber 28 is mounted at a position between the proximate end and the distal end. In both instances the concave surface 34*a* of the receptacle 34 will face the scrubber 28. Interchangeability of the position of the scrubber 28 and the receptacle 34 may be provided in any conventional manner, e.g., by connecting the scrubber 28 and the receptacle 34 by a short handle extension 25 having male connectors at opposite ends (e.g., threaded studs, male quick connect couplers, etc.), by providing the scrubber 28 with a connector at the hub that has two female connectors (internally threaded sockets, female quick connect couplers, etc.) facing 180° opposite each other, and by providing the receptacle 34 with two female connectors (internally threaded sockets, female quick connect couplers, etc.) facing 180° opposite each other. Manipulating the tool up and down will cause the scrubber 28 to dislodge soot from the walls of the chimney or flue 14. The dislodged soot will fall into receptacle 34 for retrieval and proper disposal.

Figure 4:
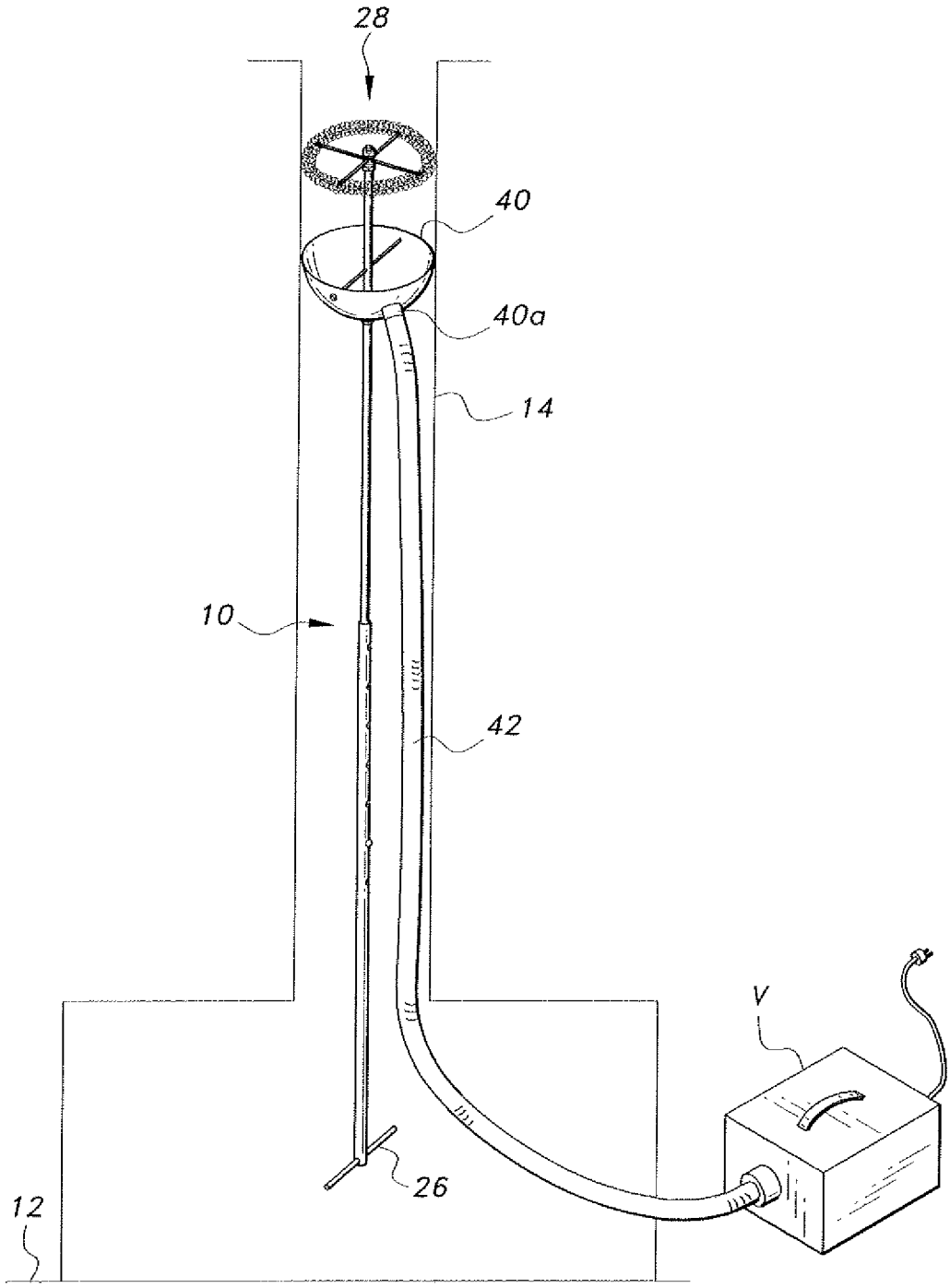
FIG. 4 is a diagrammatic environmental perspective view of a second embodiment of a chimney cleaning apparatus according to the present invention, showing the apparatus configured for cleaning the chimney from hearth or fireplace level.

FIG. 4 shows an embodiment wherein a soot collecting receptacle 40 is provided with a funnel-type outlet 40*a*. A hose 42 connects the receptacle 40 to a vacuum device V. This arrangement permits the withdrawal of dislodged soot without periodically retrieving the receptacle 40.

Figure 6:
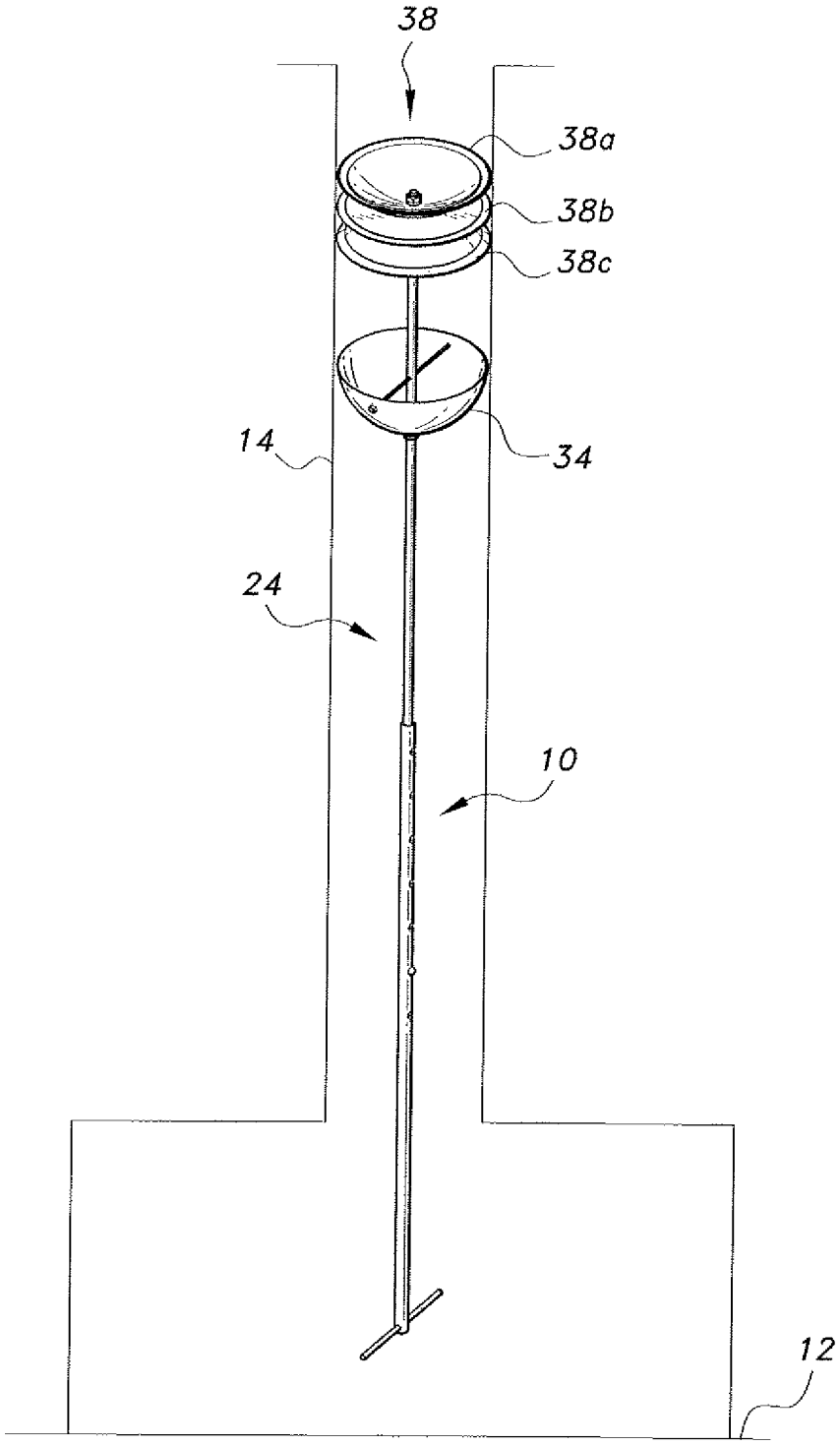
FIG. 6 is a diagrammatic environmental perspective view of a third embodiment of a chimney cleaning apparatus according to the present invention, showing the apparatus configured for cleaning the chimney from hearth or fireplace level.
Figure 7:
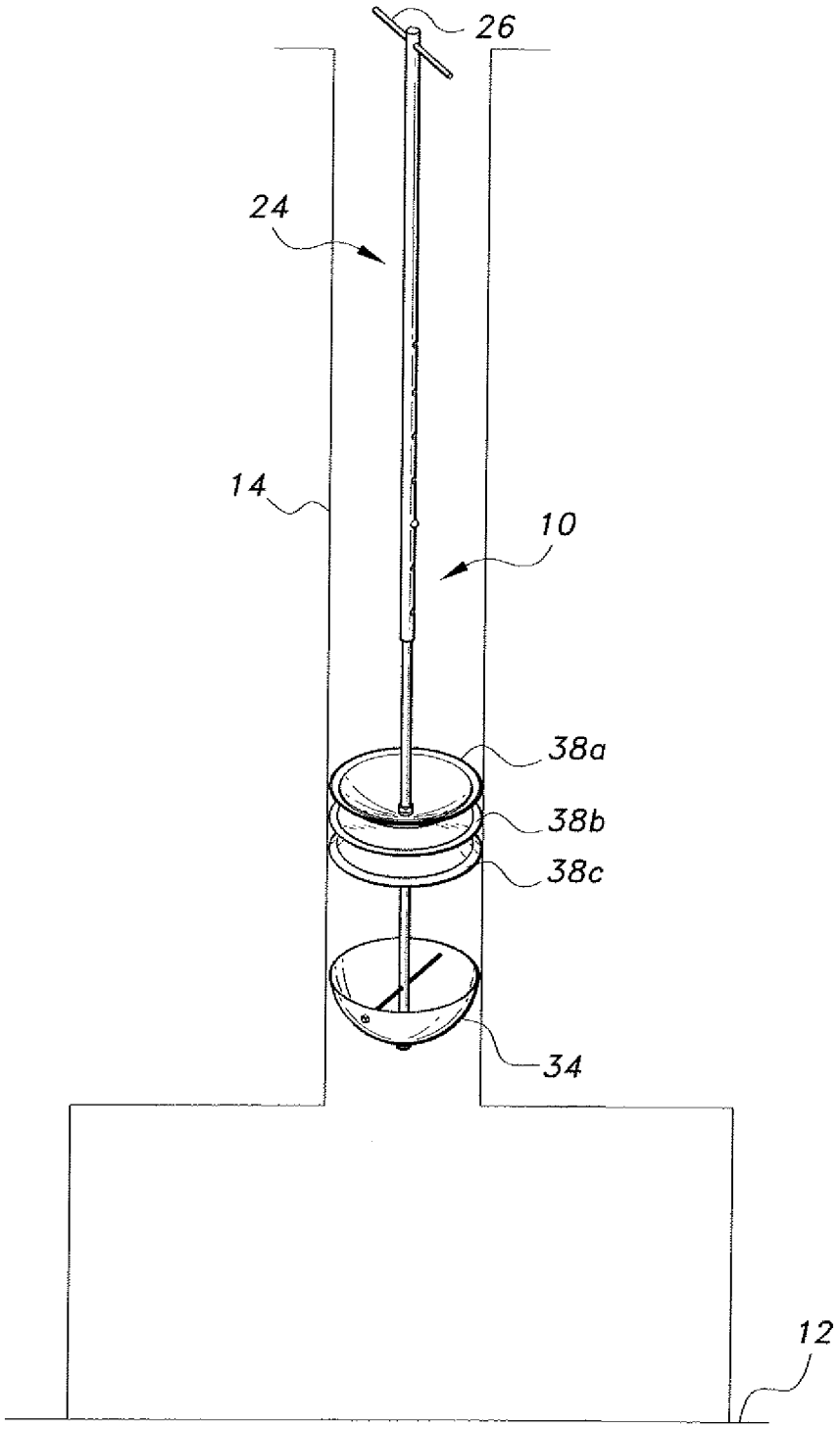
FIG. 7 is a diagrammatic environmental perspective view of the chimney cleaning apparatus of FIG. 6, showing the apparatus configured for cleaning the chimney from roof level.
Figure 8:
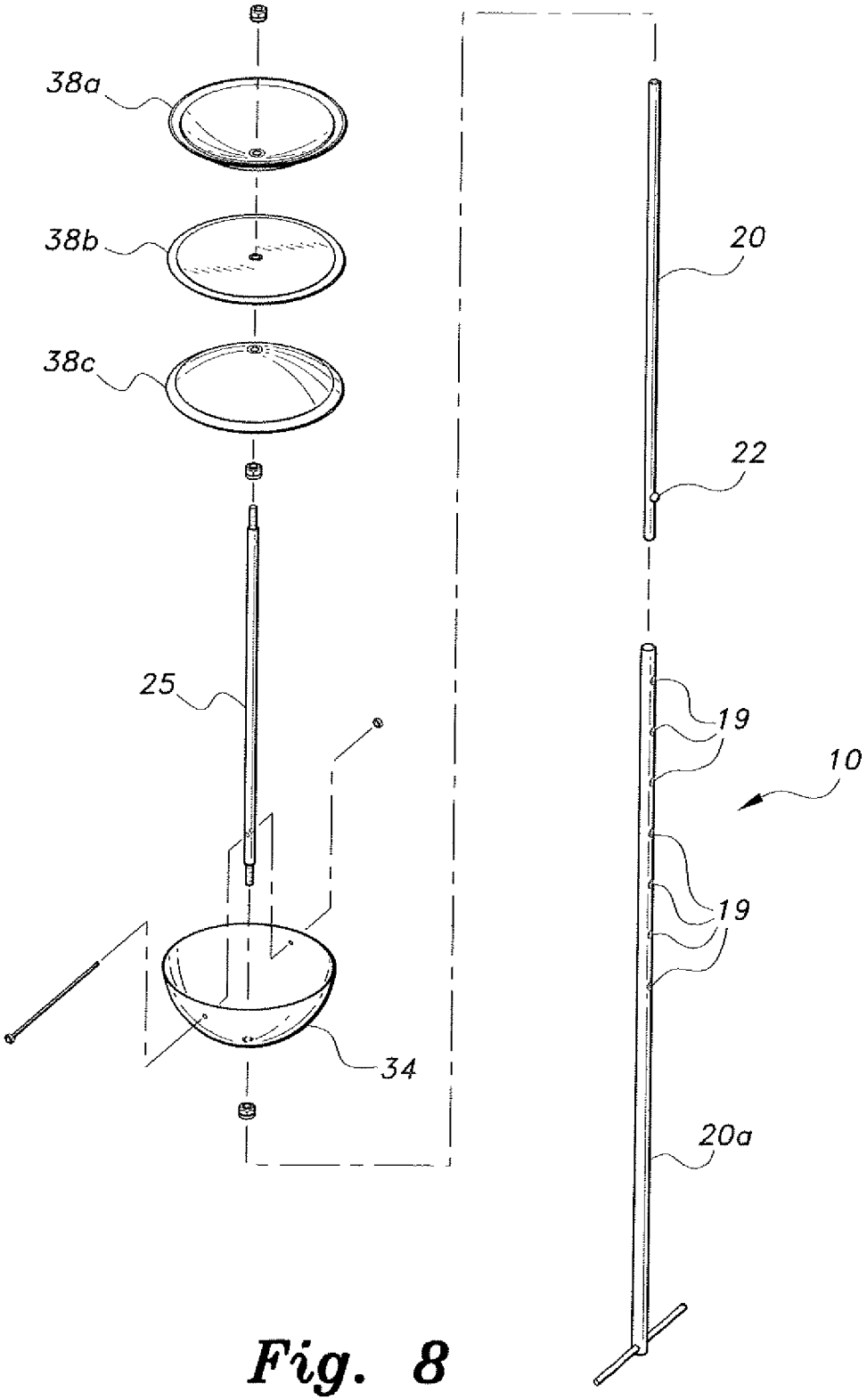
FIG. 8 is an exploded perspective view of the chimney cleaning apparatus of FIG. 6.

FIGS. 6-8 illustrate an embodiment of the apparatus wherein a different scrubber 38 is employed to scrape the soot from the interior walls of chimney 14. The scrubber of FIGS. 6-8 employs two circular, bowl-shaped members 38*a*, 38*c* having opposing concave and convex surfaces mounted on the handle 24. Each member 38*a*, 38*c* is provided with a sharp, circumferential edge for dislodging soot. A flat disc 38*b* is sandwiched between the members 38*a* and 38*c*. The disc 38*b* is also provided with a sharp, circumferential edge for dislodging soot. When mounted, the respective convex surfaces of members 38*a* and 38*c* are arranged to abut opposite surfaces of the flat disc 38*b*. This arrangement provides three scraping edges for dislodging soot from the chimney walls. The scrubber 38 can also be employed with the vacuum extraction system as described above.

It is to be understood that the present invention is not limited to the embodiments described above, but encompasses any and all embodiments within the scope of the following claims.

We claim:

1. A chimney cleaning apparatus, comprising:

a telescopically adjustable handle member having a proximal end and a distal end;

a soot scrubber member removably mounted on the handle member for dislodging soot from the chimney, said soot scrubber member comprising:

an annular ring having a circumferential edge;

a plurality of metallic scrubbing wires extending from the circumferential edge of the annular ring;

a hub having a releasable connector for releasably attaching said soot scrubber member to said telescopically adjustable handle member; and a plurality of radially extending rods attaching the annular ring to the hub; and a receptacle removably mounted on the handle member for receiving the dislodged soot therein.

2. The chimney cleaning apparatus according to claim 1, wherein said soot scrubber member is mounted at the distal end of said handle member and the receptacle is mounted between the distal end and the proximal end of said handle member.

3. The chimney cleaning apparatus according to claim 2, wherein said receptacle is mounted at the distal end of said handle member and the soot scrubber member is mounted between the distal end and the proximal end of said handle member.

4. The chimney cleaning apparatus according to claim 1, wherein said receptacle defines a convex surface facing said soot scrubber for receiving the dislodged soot.

5. The chimney cleaning apparatus of claim 1, wherein said receptacle has an outlet port, the chimney cleaning apparatus further including a vacuum connected to the outlet port.

6. A chimney cleaning apparatus, comprising:

a telescopically length-adjustable handle member having a proximal end and a distal end;

a handgrip disposed at the proximate end of the handle member;

a soot scrubber member removably mounted on the handle member for dislodging soot from the chimney, said soot scrubber member comprising:

an annular ring having a circumferential edge;

a plurality of metallic scrubbing wires extending from the circumferential edge of the annular ring;

a hub having a releasable connector for releasably attaching said soot scrubber member to said telescopically length-adjustable handle member; and a plurality of radially extending rods attaching the annular ring to the hub; and a receptacle removably mounted on the handle member, the receptacle having a concave surface facing the soot scrubber member for receiving the dislodged soot therein.

7. The chimney cleaning apparatus according to claim 6, wherein said soot scrubber member is mounted at the distal end of said handle member and the receptacle is mounted between the distal end and the proximal end of said handle member.

8. The chimney cleaning apparatus according to claim 7, wherein said receptacle is mounted at the distal end of said handle member and the soot scrubber member is mounted between the distal end and the proximal end of said handle member.

9. The chimney cleaning apparatus of claim 6, wherein said receptacle has an outlet port, the chimney cleaning apparatus further comprising a vacuum connected to the outlet port.

* * * * *